US005709096A

United States Patent [19]

Tamai et al.

[11] Patent Number: 5,709,096

[45] Date of Patent: Jan. 20, 1998

[54] DEFROSTING DEVICE FOR A LOW TEMPERATURE DISPLAY CASE

[75] Inventors: Hirokuni Tamai; Hirotaka Nakano; Hisao Sagara, all of Gunma, Japan

[73] Assignee: Sanyo Electric Company, Ltd., Osaka, Japan

[21] Appl. No.: 731,345

[22] Filed: Oct. 11, 1996

[30] Foreign Application Priority Data

Oct. 11, 1995 [JP] Japan ..... 7-289247

[51] Int. Cl.[6] ..... F25D 21/06

[52] U.S. Cl. ..... 62/155; 62/156; 62/234

[58] Field of Search ..... 62/155, 156, 234

[56] References Cited

U.S. PATENT DOCUMENTS

| | | | |
|---|---|---|---|
| 3,023,589 | 3/1962 | Jacobs | 62/156 |
| 3,333,437 | 8/1967 | Brennan | 62/155 |
| 3,383,877 | 5/1968 | Liebermann et al. | 62/156 |
| 3,774,406 | 11/1973 | Reitblatt | 62/155 |
| 4,697,136 | 9/1987 | Ishikawa | 323/267 |
| 4,732,010 | 3/1988 | Linstromberg et al. | 62/155 |
| 4,993,233 | 2/1991 | Borton et al. | 62/155 |
| 5,031,413 | 7/1991 | Tsuihiji et al. | 62/155 |
| 5,268,832 | 12/1993 | Kandatsu | 363/95 |

FOREIGN PATENT DOCUMENTS

| | | | |
|---|---|---|---|
| 44 33 428 A | 3/1996 | Germany . | |
| 06 272991 A | 12/1994 | Japan . | |
| 07 281774 A | 10/1995 | Japan . | |
| 817075 | 7/1959 | United Kingdom | 62/155 |

*Primary Examiner*—William E. Tapolcai
*Attorney, Agent, or Firm*—Darby & Darby

[57] ABSTRACT

The object of the present invention is to provide a defrosting device, for a low temperature display case, that can effectively prevent incomplete defrosting, and that can reduce the temperature increase in a storage chamber during defrosting to the minimum.

According to the present invention, a defrosting device comprises: defrosting heaters provided in a duct; a first defrost recovery temperature sensor for detecting an air temperature in the duct; a second defrost recovery temperature sensor for detecting a temperature at the evaporator; and a controller for, during a defrosting operation for the evaporator, rendering the defrosting heaters conductive, supplying a high temperature refrigerant to the evaporator, and for rendering the defrosting heaters nonconductive, based on an output of the first defrost recovery temperature sensor, and halting a flow of the high temperature refrigerant to the evaporator, based on an output of the second defrost recovery temperature sensor.

4 Claims, 6 Drawing Sheets

DEFROSTING DEVICE FOR A LOW TEMPERATURE DISPLAY CASE

BACKGROUND OF THE INVENTION

FIELD OF THE INVENTION

The present invention relates to a defrosting device, for a low temperature display case, that employs a high temperature refrigerant and defrosting heaters to defrost an evaporator that is disposed in a duct.

Conventionally, as is described in, for example, Japanese Examined Patent Publication No. Hei 3-45307 (F23D23/08), a low temperature display case of the above described type is designed with a division wall, positioned on the internal face of a substantially C-shaped heat insulation wall, and a deck pan, positioned at the bottom, that define a storage chamber and a duct, and has an evaporator and a blower provided in the duct. With this design, cooled air, which is obtained with the blower through heat exchange, is circulated through the storage chamber.

Since frost builds up on the evaporator during the cooling operation, periodic defrosting is required. Especially for a refrigerating display case where chilled confections, such as ice cream, are displayed, the temperature rise in a storage chamber that occurs during defrosting must be limited, otherwise, the quality of the goods will be substantially degraded.

During the defrosting operation for a refrigerating display case, conventionally, a refrigerant is discharged at a high temperature from a compressor and transferred to an evaporator to heat it from the inside, and warm air is transmitted to the evaporator from defrosting heaters provided in a duct so as to complete the defrosting in a short time.

During the defrosting of the evaporator, conventionally, based on the output of a defrost recovery temperature sensor, which detects the temperature at the refrigerant outlet of the evaporator, the flow of the high temperature refrigerant into the evaporator is halted when the temperature reaches a predetermined defrost recovery temperature, for example, +10° C. And the defrosting heaters are continuously conductive during a period for dripping (a period that continues until water produced when frost is thawed has fallen off the evaporator).

However, temperature increases in the individual sections of the evaporator during defrosting are not uniform. When defrosting is incompletely performed, the frost that remains deteriorates the cooling function, and will break the evaporator.

Conventionally, in order to prevent incomplete defrosting, the defrosting heaters are conductive for a long time, or a high defrost recovery temperature is set at the defrost recovery temperature sensor. Also, the time required for defrosting and dripping is greatly extended, which causes the temperature in the storage chamber to rise. Since the temperature of a refrigerant is not increased, especially in winter, the defrosting period is extremely long.

SUMMARY OF THE INVENTION

To resolve the above described technical shortcomings, it is one object of the present invention to provide a defrosting device, for a low temperature display case, that can effectively prevent incomplete defrosting, and that can reduce the temperature increase in a storage chamber during defrosting to the minimum.

According to the present invention, a defrosting device, which is applied for a low temperature display case where cooled air is generated, by heat exchange at an evaporator disposed in a duct, and is circulated through a storage chamber by a blower, comprises:

defrosting heaters provided in a duct;

a first defrost recovery temperature sensor for detecting an air temperature in the duct;

a second defrost recovery temperature sensor for detecting a temperature at the evaporator; and a controller for, during a defrosting operation for the evaporator, rendering the defrosting heaters conductive, supplying a high temperature refrigerant to the evaporator, and for rendering the defrosting heaters nonconductive, based on an output of the first defrost recovery temperature sensor, and halting a flow of the high temperature refrigerant to the evaporator, based on an output of the second defrost recovery temperature sensor.

In the defrosting device of the present invention, when a flow of the high temperature refrigerant to the evaporator is halted, the controller stops the supply of power to the defrosting heaters.

DETAILED DESCRIPTION OF THE PREFERRED EMBODIMENT

Figure 1:
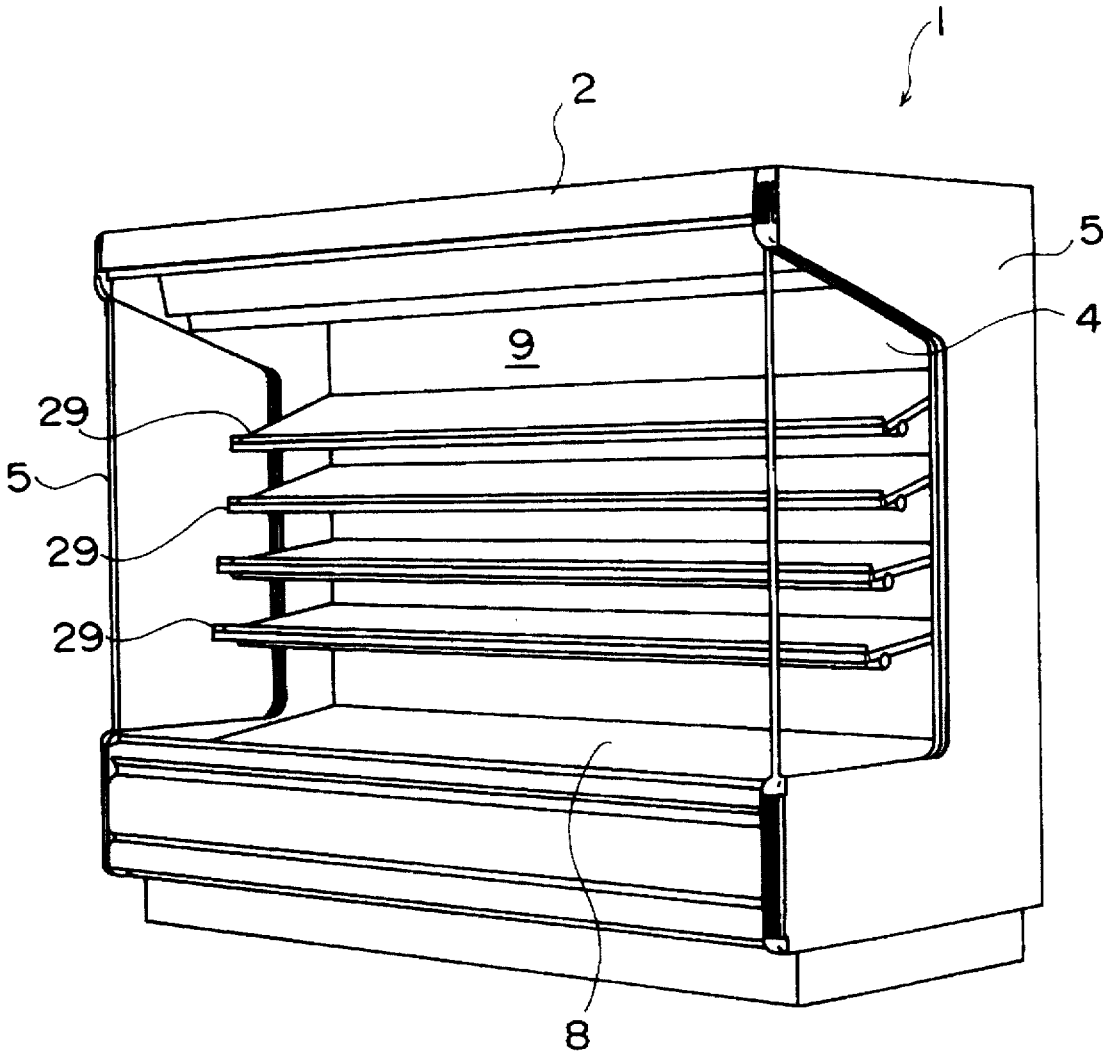
FIG. 1 is a perspective view of a low temperature display case according to one embodiment of the present invention.
Figure 2:
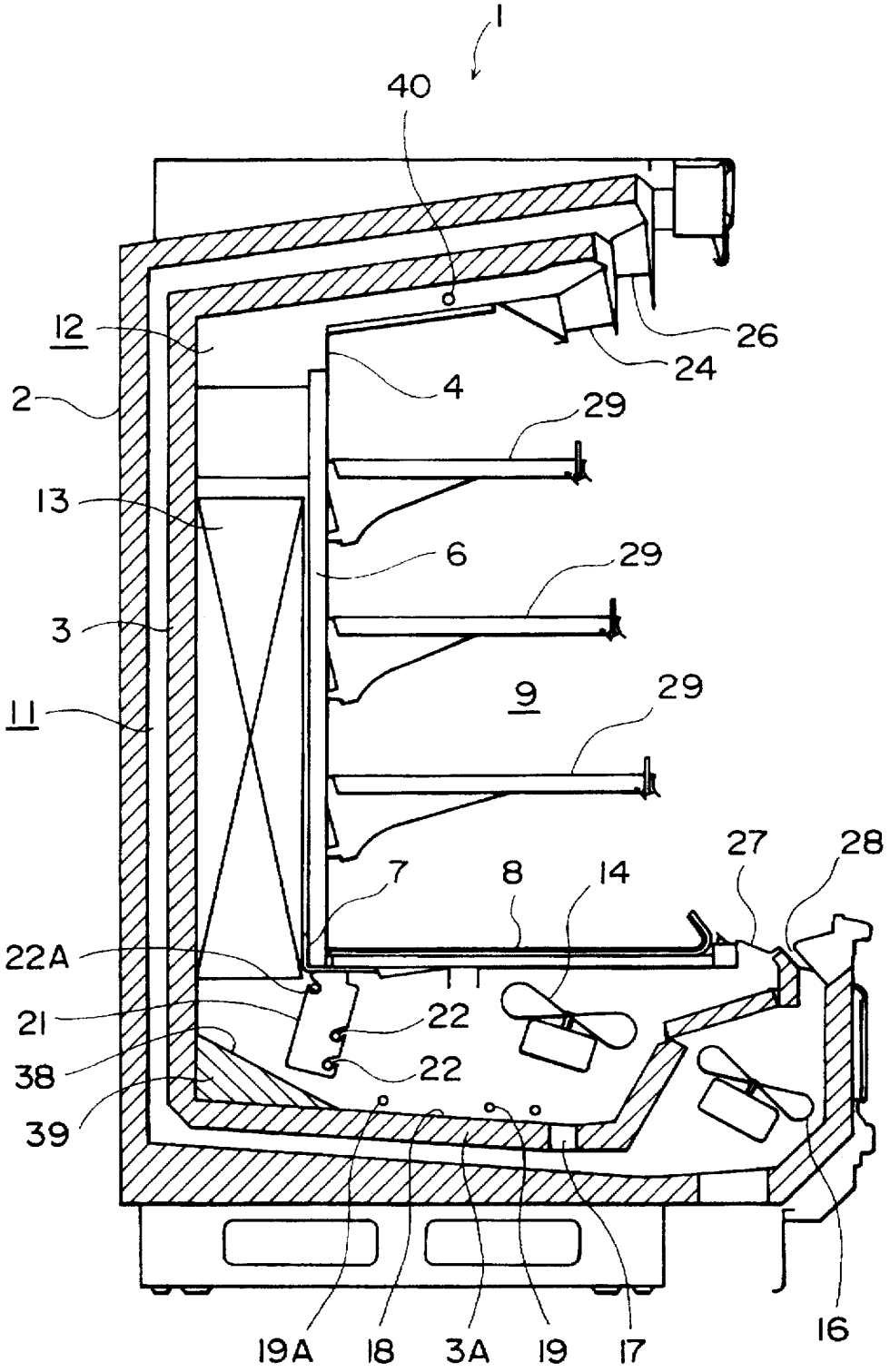
FIG. 2 is a vertical cross sectional side view of the low temperature display case according to the present invention.
Figure 3:
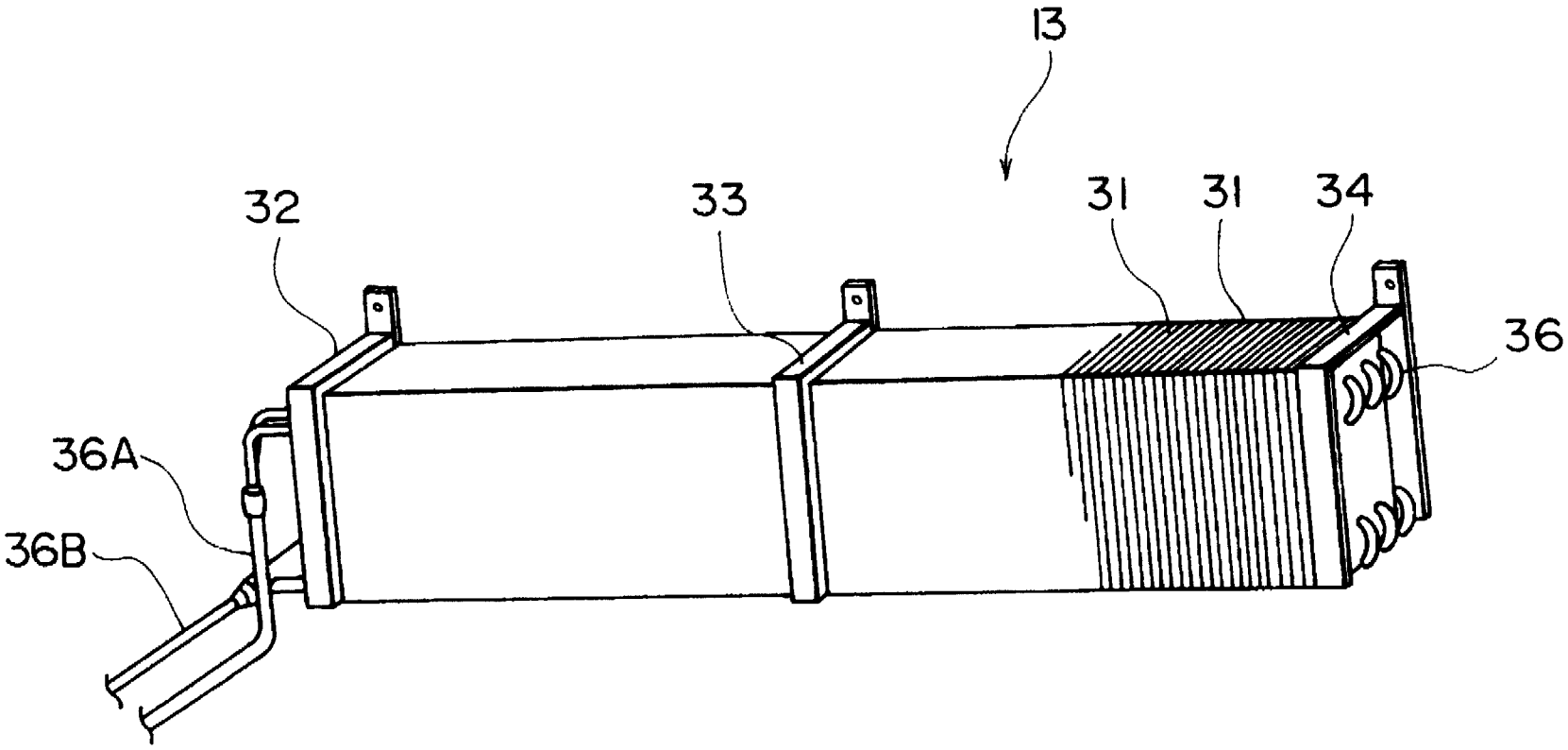
FIG. 3 is a perspective view of an evaporator in the low temperature display case according to the present invention.
Figure 4:
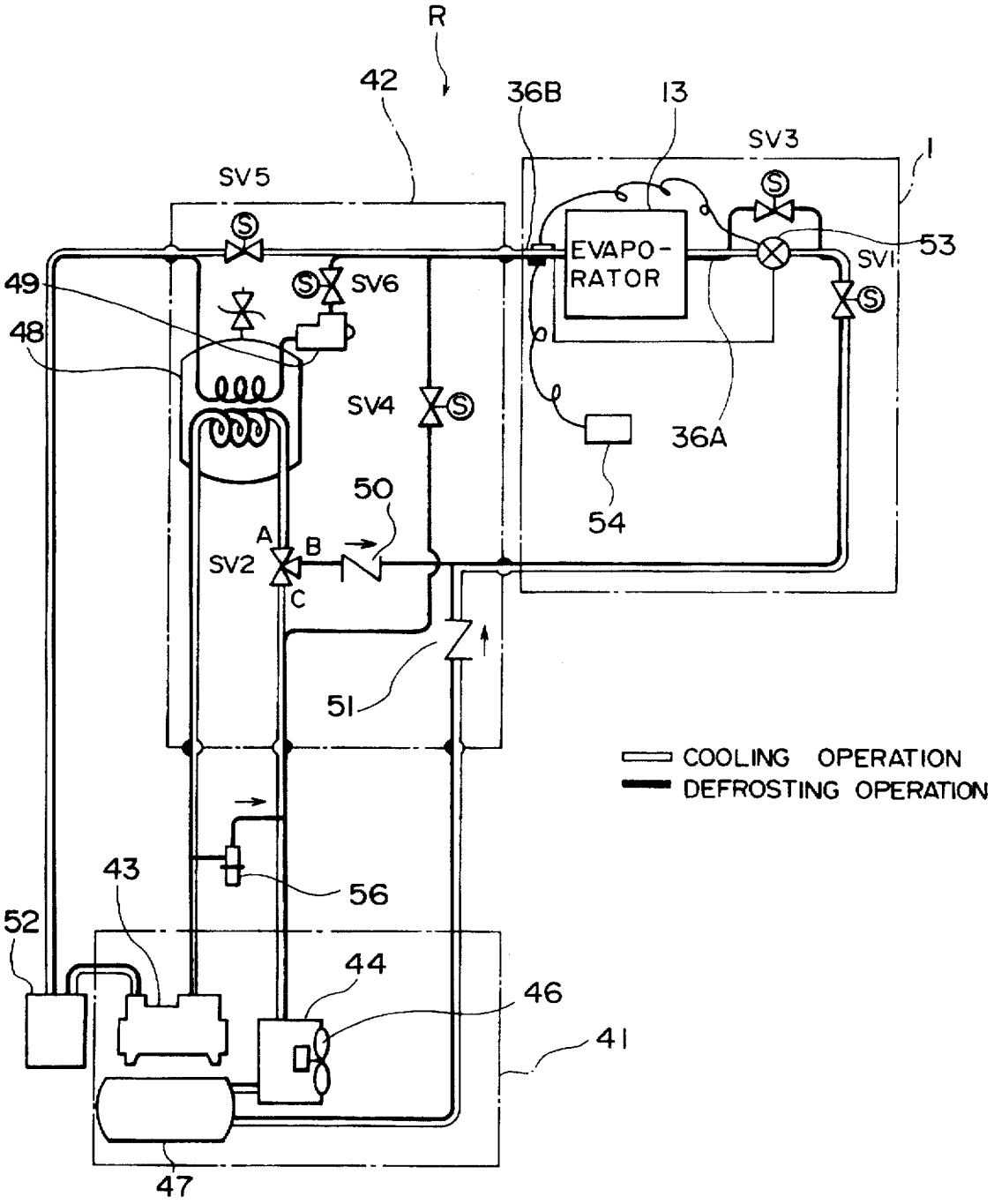
FIG. 4 is a refrigerant circuit diagram of a cooling device for cooling the low temperature display case of the present invention.

The preferred embodiment of the present invention will now be described in detail while referring to the accompanying drawings. FIG. 1 is a perspective view of a low temperature display case 1 according to the present invention; FIG. 2 is a vertical cross sectional side view of the low temperature display case 1; FIG. 3 is a perspective view of an evaporator 13; and FIG. 4 is a refrigerant circuit diagram for a cooling device R for cooling the low temperature display case 1.

The low temperature display case 1 of the present invention is a refrigerating open-front display case that is installed in a store, such as a supermarket or a convenience store, to display chilled confections, such as ice cream, that are for sale. The low temperature display case 1 has a substantially C shaped heat insulation wall 2, and side plates 5 that are attached to both sides of the insulation wall 2. Heat insulation division wall 3, which is substantially C shaped, is so mounted inside the heat insulation wall 2 that there is an intervening space between them. A partition panel 4 is provided inside the upper portion of the heat insulation division wall 3 and extends outward, describing an intervening space. Deck struts 6 are provided at both ends and in the center of the partition panel 4.

The lower ends of the deck struts 6 and of the partition panel 4 are secured either directly or via another member to a metal fitting 7, the ends of which are fixed to frames (not shown) on either side of the heat insulation wall 2. In front of the lower portion of the partition panel 4, a deck pan 8 is provided, with an intervening space, above a bottom wall 3A of the heat insulation division wall 3. A storage chamber 9, which is open to the front, is defined by an area enclosed by the partition panel 4 and the deck pan 8. An outer duct 11 that is formed between the heat insulation wall 2 and the heat insulation division wall 3, and an inner duct 12 that is formed between the heat insulation division wall 3 and the partition panel 4 and the deck pan 8, communicate with the upper, the rear and the lower portions of the storage chamber 9.

An evaporator 13 that is included in a cooling device is provided upright at the rear inside the inner duct 12. As is shown in FIG. 3, the evaporator 13 comprises a plurality of aluminum heat exchange fins 31, tube sheets 32, 33 and 34, which are located at the center and the sides of the heat exchange fins 31; and a sinuously shaped refrigerant pipe 36 that is passed through the tube sheets 32, 33 and 34. The refrigerant pipe 36 has a refrigerant inlet 36A and a refrigerant outlet 36B at its left end near the tube sheet 32.

The center tube sheet 33 and the right end tube sheet 34, both of which are located away from the refrigerant inlet 36A, are made of an aluminum alloy that is a metal having high thermal conductivity. The tube sheet 32 at the left end of the refrigerant pipe 36 is made of galvanized steel or stainless steel, as is a conventional one. This is because brazing is used to connect bent pipes to the refrigerant inlet and outlet 36A and 36B, and the tube sheet would melt if it were formed of aluminum.

The front lower ends of the tube sheets 32, 33 and 34 of the evaporator 13 are fixed to the metal fitting 7. The metal fitting 7 is also made of an aluminum alloy that is a metal having high thermal conductivity, and has a plurality of holes are formed in it. A suction blower 14 (for an inner duct) is provided below the deck pan 108 in the front internal portion of the inner duct 12, and a suction blower 16 (for an outer duct) is provided in the front internal portion of the outer duct 11, which at that point is located below the inner duct 12.

The top surface of the bottom wall 3A, of the heat insulation division wall 3, inclines downward at an angle of 4 degrees, for example, toward a drain hole 17, which is located beneath the blower 14. The top face of the bottom wall 3A, therefore, serves as a drain pan 18, and drain pan heaters (electric heaters) 19 for the drain pan 18 are provided near the drain hole 17, which communicates with the outer duct 11. Defrosting heaters (electric heaters) 22 and an attachment plate 21 are provided inside the inner duct 12 at the upper rear portion of the drain pan 18.

When, during the defrosting operation, water from the evaporator 13 contacts the defrosting heaters 22, the amount of heat generated is considerably reduced, and steam may be produced. Therefore, the defrosting heaters 22 are located forward of the evaporator 13 and under the metal fitting 7, so that during defrosting, water falling from the evaporator 13 will not fall directly onto the heaters 22. A part 22A, one of the defrosting heaters 22, is located near the metal fitting 7.

A slope member 38 is provided on the drain pan 18 at a position that is directly beneath the evaporator 13. The slope member 38 is made of stainless steel, and its surface is inclined downward toward the drain hole 17 at an inclination angle that is greater than that of the drain pan 18. The slope member 38 is mounted on, and extends from one side to the other of the drain pan 18. With this arrangement, the surface of the slope member 38 is positioned near the defrosting heaters 22.

Further, heat insulation material 39, foamed styrol, is used to fill the slope member 38 (adjacent to the heat insulation division wall 3), and a part 19A, one of the drain pan heaters 19, is located near the slope member 38.

The upper ends of the inner and outer ducts 12 and 11 communicate respectively with an inner discharge opening 24 and an outer discharge opening 26, which are positioned near the upper edge of the open side of the storage chamber 9. An inner intake opening 27 and an outer intake opening 28 are formed at the lower edge of the open side of the storage chamber 9. From the front, the inner intake opening 27 is located behind the outer intake opening 28. The inner intake opening 27 communicates with the inner duct 12, and the outer intake opening 28 communicates with the outer duct 11.

A first defrost recovery temperature sensor 40 for the defrosting heaters 22 is provided at the upper portion of the inner duct 12 (upstream of the inner discharge opening 24). Decks 29 are supported by the strut 6 as a series of steps, and frozen foods, such as ice cream, are displayed on the decks 29.

In a refrigerant circuit shown in FIG. 4, a cooling device R comprises a condensing unit 41; a circuit for the low temperature display case 1; a hot gas (high temperature refrigerant) defrosting circuit (hereinafter referred to as a defrost controller) 42; an accumulator 52; and an ejection pressure adjustment valve 56.

The condensing unit 41 includes a compressor 43; a condenser 44; a blower 46 for a condenser; and a fluid reservoir 47. The circuit for the display case 1 includes the above described evaporator 13; an expansion valve 53; solenoid valves SV1 and SV3; and a second defrost recovery temperature sensor 54 for the defrost controller 42.

The defrost controller 42 has a heat storage tank 48; an intake pressure adjustment valve 49; a threeway valve SV2; solenoid valves SV5, SV6 and SV4; and check valves 50 and 51. The discharge side of the compressor 43 communicates with the heat storage tank 48 and is connected to the inlet (A) of the threeway valve SV2. The outlet (C) of the threeway valve SV2 is connected to the condenser 44, which communicates with the fluid reservoir 47.

The fluid reservoir 47 is connected to the solenoid valve SV1 via the check valve 51 and a high pressure refrigerant pipe 60. The solenoid valve SV1 is connected to the refrigerant inlet 36A of the evaporator 13 via the expansion valve 53. The heat sensing portion of the expansion valve 53 is attached to the refrigerant outlet 36B of the evaporator 13, and the solenoid valve SV3 is connected in parallel so as to short circuit the expansion valve 53. The second defrost recovery temperature sensor 54 is attached to the refrigerant outlet 36B of the refrigerant pipe 36 for the evaporator 13.

The refrigerant outlet 36B of the evaporator 13 is connected to the intake pressure adjustment valve 49 via the solenoid valve SV6, and the pipe from the intake pressure adjustment valve 49 is passed through the heat storage tank 48 and is connected to the accumulator 52. The accumulator 52 is connected to the intake side of the compressor 43.

The solenoid valve SV5 short-circuits the solenoid valve SV6, the intake pressure adjustment valve 49, and the heat storage tank 48. The outlet (B) of the three-way valve SV2 is connected via the check valve 50 to the high pressure refrigerant pipe 60 on the outlet side of the check valve 51. Further, the outlet (C) of the threeway valve SV2 and the inlet of the solenoid valve SV6 communicate with each other via the solenoid valve SV4. In addition, the ejection pressure adjustment valve 56 is connected between the discharge side of the compressor 43 and the outlet (C) of the three-way valve SV2.

Figure 5:
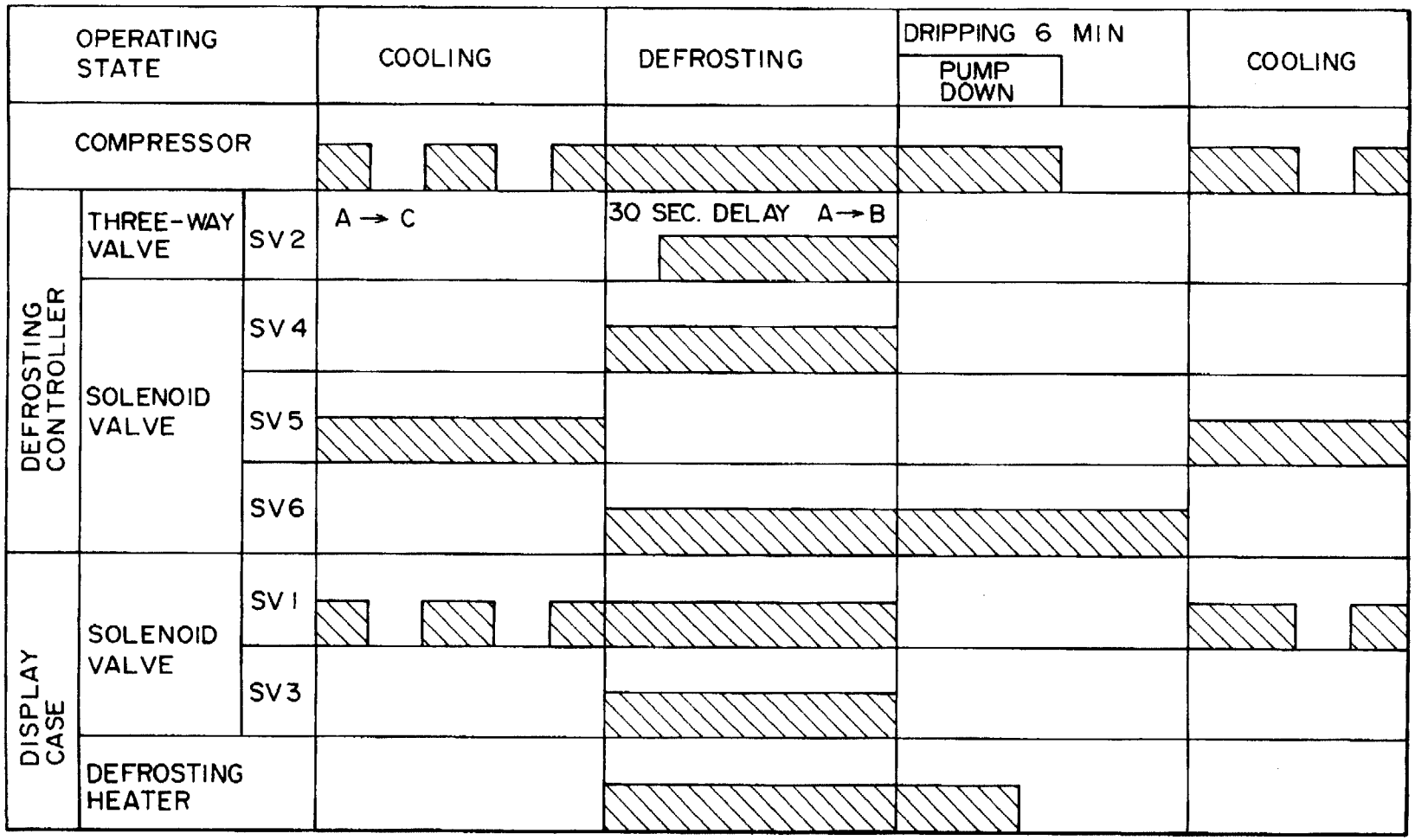
FIG. 5 is a timing chart for explaining the operation of the cooling device, including the low temperature display case of the present invention.

An explanation will now be given for the operations performed by the thus arranged cooling device R, including the low temperature display case 1, while referring to the timing chart in FIG. 5. During the cooling operation, a controller (not shown) sets a flow path across the threeway valve SV2 from A to C, and the solenoid valves SV4, SV6 and SV3 are closed. The solenoid valve SV5 is opened, and when the temperature in the storage chamber 9 in the low temperature display case 1 (or the discharged cool air temperature) becomes high, the solenoid valve SV1 is opened.

Under these conditions, when the compressor 43 is activated to drive the blowers 14, 16 and 46, refrigerant gas at a high temperature and under high pressure from the compressor 43 is passed through the heat storage tank 48 and flows via the three-way valve SV2 to the condenser 44 along pipes represented in FIG. 4 by open parallel lines. The refrigerant is cooled by the blower 46 and the heat is released, and as a result, the refrigerant gas is condensed and liquefied. The refrigerant that has been condensed by the condenser 44 is separated from uncondensed refrigerant gas in the fluid reservoir 47, and only liquid refrigerant is fed through the check valve 51, the high pressure refrigerant pipe 60, and the solenoid valve SV1 to the expansion valve 53.

When the liquid refrigerant reaches and passed through the expansion valve 53, the pressure on it is reduced, and it flows through the refrigerant pipe 36 to the evaporator 13 where it is vaporized and cooling function is performed. The air that is dram in by the blower 14 is impelled toward the evaporator 13. The air that is cooled by heat exchange while passing through the evaporator 13, and rises along the inner duct 12 until it is discharged, toward the front opening of the storage chamber 9, from the inner discharge opening 24, which is formed at the upper edge of the front opening. As a result, a curtain of cooled air covers the front opening of the storage camber 9, while part of the cooled air circulates through the storage chamber 9 and cools that area.

The air that is drawn in by the blower 16 rises along the outer duct 11, and is discharged, toward the front opening of the storage chamber 9, from the outer discharge opening 26, which is formed at the upper edge of the front opening. Thus, a protective air curtain is formed outside the curtain of cooled air.

The refrigerant is discharged from the refrigerant outlet 36B of the evaporator 13, and flows through the solenoid valve SV5 to the accumulator 52. In the accumulator 52, unvaporized liquid refrigerant is separated from the refrigerant in the gaseous form, and only refrigerant in the gaseous form is fed into the compressor 43.

When the temperature in the storage chamber 9 has fallen to, for example, −21° C. during the cooling operation, the controller closes the solenoid valve SV1 in accordance with the output of a temperature sensor (not shown). Since the flow of the refrigerant to the evaporator 13 is interrupted, the cooling function performed by the evaporator 13 is halted. The intake pressure at the compressor 43 is thereafter reduced and the compressor 43 is halted by a low pressure switch (not shown).

When the temperature in the storage chamber 9 has risen to, for example, 19 C., the controller opens the solenoid valve SV1. Accordingly, the intake pressure at the compressor 43, the compressor 43 is activated, and the cooling cycle is begun. By repeating the above process, on average, the storage chamber 9 is maintained at a refrigerating temperature of −20° C.

During the cooling operation, frost builds up on the evaporator 13 and in the inner duct 12. To dispel this frost, while the blowers 14 and 16 are driven, the controller periodically renders the defrosting heaters 22 and the drain pan heater 19A conductive. The evaporator 13 is heated by warm air that is blown across it by the blower 14, and the drain pan 18 is also heated. When the defrosting operation is begun, the solenoid valves SV1, SV4, SV6 and SV3 are opened and the solenoid valve SV5 is closed.

During the period when the pressure in the evaporator 13 is brought low by opening the solenoid valve SV4, refrigerant at a high temperature flows from the condenser 44 to the evaporator 13. After a time delay of 30 seconds following the start of the defrosting operation, the controller switches the threeway valve SV2 so that the flow path is from A to B.

Consequently, refrigerant gas that is discharged at a high temperature and under high pressure from the compressor 43 is passed through the heat storage tank 48, the threeway valve SV2, the check valve 51, the high pressure refrigerant pipe 60 and the solenoid valves SV1 and SV3, bypasses the expansion valve 53, and enters the evaporator 13 through the refrigerant inlet 36A.

As a consequence of the inflow of the high temperature refrigerant, the evaporator 13 is heated from the inside, and the frost is thawed by warm air from the defrosting heaters 22. The evaporator 13, therefore, is gradually defrosted. The refrigerant that has heated the evaporator 13 and has been discharged form the refrigerant outlet 36B of the evaporator 13 is fed through the solenoid valve sV6 to the intake pressure adjustment valve 49. The pressure on the refrigerant is adjusted, and the refrigerant is thereafter vaporized in the heat storage tank 48 and flows to the accumulator 52. Unvaporized liquid refrigerant is separated in the same manner as is described above, and only refrigerant in the gaseous form is drawn in by the compressor 43.

Although during the defrosting, water that falls from the evaporator 13 and ice are present on the surface of the slope member 38, the inclination of the slope member 38 is so sharp that the water flows smoothly toward the drain hole 17 in the drain pan 18 and is discharged to the exterior. Since the surface of the slope member 38 is located near the defrosting heaters 22, the temperature at the surface rises until it is 0° C. or higher. In addition, since the part 19A, one of the drain pan heaters 19, is also located near the slope member 38, the refreezing of the water that is produced when frost is thawed can be inhibited in the inner duct 12 below the evaporator 13, and incomplete defrosting can therefore be prevented.

Since the metal fitting 7 is fixed to the tube sheets 32, 33 and 34 of the evaporator 13, it is strongly affected by the cooling function of the evaporator 13. As a result, frost tends to build up on the metal fitting 7, and water that falls from the top of the evaporator 13 tends to be retained there.

However, in the present invention, since the tube sheets 33 and 34 of the evaporator 13 are made of an aluminum alloy, heat is smoothly transmitted via the refrigerant pipe 36 to the metal fitting 7. And since the metal fitting 7 is also formed of an aluminum alloy and is positioned near the defrosting heater 22A, the metal fitting is adequately heated.

At the metal fitting 7, where residual frost tends to accumulate, the frost is rapidly thawed, and as a plurality of holes are formed in the metal fitting 7, water also falls smoothly. The problem posed by the incomplete defrosting of the metal fitting 7 is resolved, and the danger that the refrigerant pipe 36 may be broken is eliminated. Although the tube sheet 32 on the refrigerant inlet 36A is not formed of an aluminum alloy, there is abundant heat at that point because refrigerant at a high temperature flows in through the inlet 36A and prevents the occurrence of incomplete defrosting.

Further, as is described above, since the drain pan heaters 19 are also rendered conductive during the defrosting, water that falls on the drain pan 18 can be prevented from refreezing, and frost and ice on other portions in the inner duct can be thawed.

When six to eight minutes have elapsed following the beginning of the defrosting operation, the defrosting of the evaporator 13 is terminated, and the temperature of the outlet 36B is raised to, for example, +10° C. (defrost recovery temperature). When that is detected by the second defrost recovery temperature sensor 54, the controller terminates the defrosting operation, begins a 6 minute dripping operation whereby the threeway SV2 is switched so that the flow path is from A to C, the solenoid valves SV4, SV5, SV3 and SV1 are closed, and the collection of refrigerant in the evaporator 13 is begun by beginning a pumping down operation.

The air temperature in the inner duct 12 does not rise to +10° C. when the temperature at the outlet 36B of the evaporator 13 is raised to +10° C. Based on the first defrost recovery temperature sensor 40, the controller maintains the defrosting heaters 22 in the conductive state until the air temperature in the inner duct 12 rises to, for example, +10° C. Therefore, even after the defrosting operation is terminated, the defrosting heaters 22 are continuously generating heat.

On the other hand, the temperature in the evaporator 14 is reduced at the start of the pumping down operation, and accordingly, the air temperature in the inner duct 12 is temporarily reduced. If heat generation by the defrosting heaters 22 were halted at this time, the temperature at the evaporator 13 would not be increased much, and incomplete defrosting would occur. As is described above, however, since the defrosting heaters 22 continue to generate heat, the air temperature in the inner duct 12, which is temporarily reduced at the start of the pumping down operation, rises again. As a result, even when a defrost recovery temperature that is to be detected by the second defrost recovery temperature sensor 54 is not high, the problem that arises when water remaining on the evaporator 13 is refrozen does not occur.

When the intake pressure of the compressor 43 is reduced, and the compressor 43 is halted by a low voltage switch (not shown), as is described above, the pumping down operation is terminated. Thereafter, when the air temperature of the inner duct 12 is increased to +10° C. by the heat generated by the defrosting heaters 22, based on the output of the first defrost recovery temperature sensor 40, the controller halts the power supply to the defrosting heaters 22.

Since the drain pan heaters 19 generate heat during the dripping period, the refreezing of water on the drain pan 18 can be prevented. When the 6 minute dripping period has elapsed, the controller closes the solenoid valve SV6 and opens the solenoid valve SV5 to restart the above described cooling operation.

Figure 6:
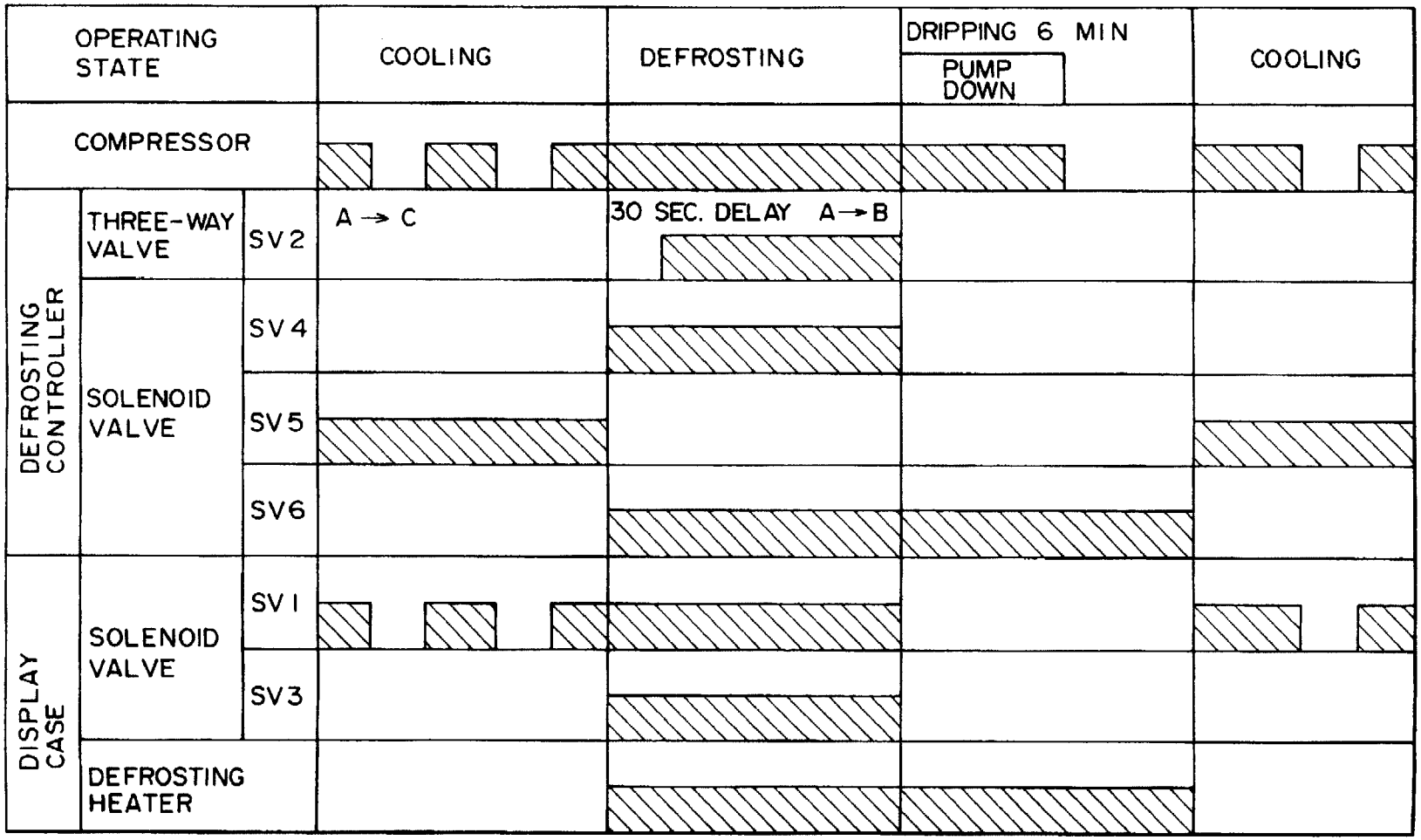
FIG. 6 is a timing chart for explaining the operation of the cooling device, including a conventional low temperature display case.

As is described above, the second defrost recovery temperature sensor 54, for detecting the temperature at the outlet 36B of the evaporator 13, and the first defrost recovery temperature sensor 40, for detecting the air temperature in the inner duct 12, are employed to independently control the time at which the supply to the evaporator 13 of gaseous refrigerant at a high temperature is halted, and the time at which the generation of heat by the defrosting heaters 22 is halted. Incomplete defrosting in the vicinity of the evaporator 13 is prevented, and compared with a conventional cooling device where defrosting heaters are conductive during a dripping period, as is shown in FIG. 6, the increase in the air temperature in the inner duct 12 can be controlled. The defrosting can be completed in a short time. Therefore, the minimum amount of heat is required for defrosting, and the temperature increase in the storage chamber 9 is reduced to the minimum.

The time at which defrosting using the high temperature refrigerant gas is terminated varies depending on seasonal changes in the ambient temperature of the condensing unit 41. Since the amount of heat generated by the defrosting heaters 22 is constant, an almost constant time can be set for halting the power supply to the defrosting heater 22 in accordance with the first defrost recovery temperature sensor 40.

As is described above in detail, according to the present invention, a low temperature display case, in which, to defrost an evaporator, a high temperature refrigerant flows through the evaporator and heat is generated by defrosting heaters that are provided in a duct, comprises: a first defrost recovery temperature sensor for detecting an air temperature in the duct; a second defrost recovery temperature sensor for detecting a temperature at the evaporator; and a controller for, during a defrosting operation for the evaporator, rendering the defrosting heaters non-conductive, based on an output of the first defrost recovery temperature sensor, and for halting a flow of the high temperature refrigerant to the evaporator, based on an output of the second defrost recovery temperature sensor. With this structure, incomplete defrosting in the vicinity of the evaporator is prevented. And compared with a conventional device for maintaining the defrosting heaters in a conductive state during the dripping period, an increase in the temperature of the air in the duct can be reduced, and the defrosting period can be shortened. Therefore, the minimum amount of heat is required for defrosting the evaporator, and the increase in the temperature of the storage chamber can be reduced to a minimum.

In particular, since the controller halts the supply of power to the defrosting heaters when the flow of the high temperature refrigerant to the evaporator is stopped, the temperature is reduced after the flow of the refrigerant is stopped, so that water that remains near the evaporator is not refrozen, and so that incomplete defrosting can be prevented.

What is claimed is:

1. A defrosting device for a low temperature display case including cooled air generated by heat exchange at an evaporator disposed in a duct and circulated through a storage chamber by a blower, comprising:

defrosting heaters provided said duct;

a first defrost recovery temperature sensor for detecting an air temperature in said duct;

a second defrost recovery temperature sensor for detecting a temperature at said evaporator; and a controller which, during a defrosting operation for said evaporator, renders said defrosting heaters operative, supplying a high temperature refrigerant to said evaporator, and renders said defrosting heaters inoperative, based on an output of said first defrost recovery temperature sensor, and halts a flow of said high temperature refrigerant to said evaporator, based on an output of said second defrost recovery temperature sensor.

2. A defrosting device according to claim 1, wherein, when a flow of said high temperature refrigerant to said evaporator is halted, said controller stops the supply of power to said defrosting heaters.

3. A defrosting device according to claim 1 wherein the display case has a drain pan below said evaporator to collect water dripping from said evaporator and further comprising heaters for said drain pan operative during defrosting of said evaporator to prevent freezing of water collecting in said drain pan.

4. A defrosting device as in claim 1 wherein said second defrost recovery temperature sensor detects the temperature of the refrigerant outlet of said evaporator.

* * * * *